US008154412B2

(12) United States Patent
Verdiramo

(10) Patent No.: US 8,154,412 B2
(45) **Date of Patent: *Apr. 10, 2012**

(54) HAND WASH MONITORING SYSTEM AND METHOD

(76) Inventor: Vincent L. Verdiramo, Martinsville, NJ (US)

( * ) Notice: Subject to any disclaimer, the term of this patent is extended or adjusted under 35 U.S.C. 154(b) by 465 days.

This patent is subject to a terminal disclaimer.

(21) Appl. No.: 12/379,130

(22) Filed: Feb. 13, 2009

(65) Prior Publication Data

US 2010/0207766 A1 Aug. 19, 2010

(51) Int. Cl.
*G08B 23/00* (2006.01)

(52) U.S. Cl. ..... 340/573.1; 340/539.11; 340/604; 340/286.07; 340/286.09; 222/52; 4/623

(58) Field of Classification Search ..... 340/573.1, 340/286.07, 286.09; 222/52, 39, 638, 639, 222/651

See application file for complete search history.

(56) References Cited

U.S. PATENT DOCUMENTS 4,805,673 A * 2/1989 Wohrle et al. ..... 141/10
4,844,017 A * 7/1989 Lackner ..... 119/52.2
5,112,477 A * 5/1992 Hamlin ..... 210/85
6,206,238 B1 * 3/2001 Ophardt ..... 222/1
6,236,317 B1 * 5/2001 Cohen et al. ..... 340/573.1
6,375,038 B1 * 4/2002 Daansen et al. ..... 222/52
6,970,574 B1 * 11/2005 Johnson ..... 382/100
7,375,640 B1 * 5/2008 Plost ..... 340/573.1
7,443,305 B2 * 10/2008 Verdiramo ..... 340/573.5
2002/0175182 A1 * 11/2002 Matthews ..... 222/52

* cited by examiner

*Primary Examiner* — George Bugg
*Assistant Examiner* — Anne Lai
(74) *Attorney, Agent, or Firm* — Thomas J. Germinario

(57) ABSTRACT

An identification badge worn by an individual is sensed when that individual enters a lavatory. The individual is also provided with an indicator device which is worn on or about the hands. Inside the lavatory, there is also provided a hand cleaning station which includes one or more indicator readers that determines whether the indicator device is in close proximity and dispenses soap on the individual's hands, then provides an appropriate indication to a computer system. Should the badge sensor sense the individual's departure from the lavatory without an appropriate indication being generated by the indicator readers, a warning signal is generated, which is sent to the computer system and to an appropriate officer, who can then address the individual.

21 Claims, 6 Drawing Sheets

HAND WASH MONITORING SYSTEM AND METHOD

FIELD OF THE INVENTION

The present invention relates generally to security systems and, more particularly, concerns a system and method for monitoring whether individuals using a lavatory or similar facility wash their hands.

BACKGROUND OF THE INVENTION

The present invention is an improvement of the "Hand Wash Monitoring System and Method" as disclosed in U.S. Pat. No. 7,443,305, issued Oct. 28, 2008, to Vincent L. Verdiramo, which patent is hereafter referred to as the "2008 Hand Wash Patent", the contents of which are incorporated herein by reference.

As described in the 2008 Hand Wash Patent, when a monitored individual, such a restaurant employee, enters or exits a lavatory, an identification device worn by the monitored individual is sensed by an identity sensor located near the lavatory door. The monitored individual also wears an indicator device on or about his/her hands. Inside the lavatory, there is a hand cleaning station that has soap dispensers positioned above a dispenser opening, within which is a pair of indicator readers that are activated by detecting the indicator device when the monitored individual inserts his/her hands into the dispenser opening. Should the identity sensor sense the individual's departure from the lavatory without receiving confirmation of hand washing activity from the indicator readers, a warning signal is generated, which is sent to the computer system and to an appropriate officer, who can then reprimand the individual.

In the preferred embodiment described in the 2008 Hand Wash Patent, the hand cleaning station also has a sensor light emitter that projects one or more light beams across the dispenser opening to a sensor light reader, such that when the hands of the monitored individual are inserted into the dispenser opening to access the soap dispenser, the light beams are broken and a corresponding signal is sent to a dispensing controller, which dispensing controller responds to the signal by activating the soap dispensers to deposit a hand wash solution on the hands of the monitored individual.

The preferred embodiment described in the 2008 Hand Wash Patent has the disadvantage of having redundant hand detection apparatus in the hand wash station, insofar as it requires both a pair of indicator readers and a sensor light emitter-receiver pair, with the former serving to detect the indicator device on the monitored individual's hands and the latter serving to dispense soap onto the individual's hands. This redundancy adds both to the expense of the hand cleaning station and the potential for malfunction.

In the present invention, this redundancy is eliminated by utilizing the indicator readers alone to perform both functions, i.e. both detecting the presence of the individual's hands within the dispenser opening and activating the soap dispenser. The present invention also further refines the hand cleaning stations design by providing a mechanism for computerized control of the amount of hand wash solution dispensed by the soap dispensers.

SUMMARY OF THE INVENTION

The present invention is an improved system and method for monitoring cleaning of the hands of one or more monitored individuals. The system comprises an enclosed area, typically a lavatory, accessed by one or more doors. One or more identity sensors are located within the enclosed area, with each identity sensor being proximate to one of the doors. One or more cleaning stations located within the enclosed area, with each cleaning station comprising one or more sinks, each sink having one or more water faucets, one or more soap dispensers and one or more drains. One or more pairs of indicator readers are located within each of the cleaning stations, each pair of indicator readers comprising an indicator reader A and an indicator reader B. Indicator reader A is located proximate to the soap dispenser and indicator reader B being located below indicator reader A, such that the space between indicator reader A and indicator reader B constitutes a dispenser opening through which the hands of the monitored individual are inserted in order to access the soap dispenser.

An identification device, such as a badge, is worn by each monitored individual, such that when the monitored individual enters or leaves the enclosed area through one of the doors, the identity sensor that is proximate to the door senses the identification device and transmits the identity of the monitored individual who has passed through the door to a system control device. In the preferred embodiment, the system control device is a CPU controller box located within each cleaning station that communicates wirelessly with a remote computer.

Each monitored individual wears on or about one or both hands one or more indicator devices, such a bracelet or wristband. When the hands of the monitored individual are placed beneath the soap dispenser in the dispenser opening between indicator reader A and indicator reader B, both indicator readers A and B sense the presence of the indicator device(s) and transmit an indication signal to the system control device indicating that the monitored individual has washed his/her hands. Upon receiving the indication signal, the system control device sends an activation signal to a dispensing controller, which dispensing controller responds to the activation signal by activating the soap dispenser to deposit a hand wash solution on the hands of the monitored individual.

In the preferred embodiment, the dispensing controller comprises a motor and a helical screw conveyor. The activation signal causes the motor to be activated for a designated time interval. The motor has a shaft which rotates when the motor is activated. The shaft is coupled to the helical screw conveyor by a gearing means, consisting to two gears, which can be spur, helical, worm, or bevel gears. Thus, when the motor is activated by the activation signal, the helical screw conveyor rotates for the designated time interval, thereby drawing a set quantity of hand wash solution out of a storage tank that is fluidly connected to the dispensing controller. The set quantity of hand wash solution dispensed is determined by the system control device based on the rotational speed of the motor, the gear ratio, the designated time interval, and the depth and pitch of the thread of the helical screw conveyor.

An alarm generates a warning signal whenever the system control device has received transmissions from the identity sensor(s) indicating that the monitored individual has entered and exited from the enclosed area without the system control device also having received a signal from both indicator reader A and indicator reader B that the monitored individual has washed his/her hands.

BRIEF DESCRIPTION OF THE DRAWINGS

The foregoing brief description, as well as other features and advantages of the present invention will be understood more completely from the following detailed description of a presently preferred, but nonetheless illustrative, embodiment of the invention, with reference being had to the accompanying drawings in which.

DETAILED DESCRIPTION OF THE PREFERRED EMBODIMENT

Figure 1:
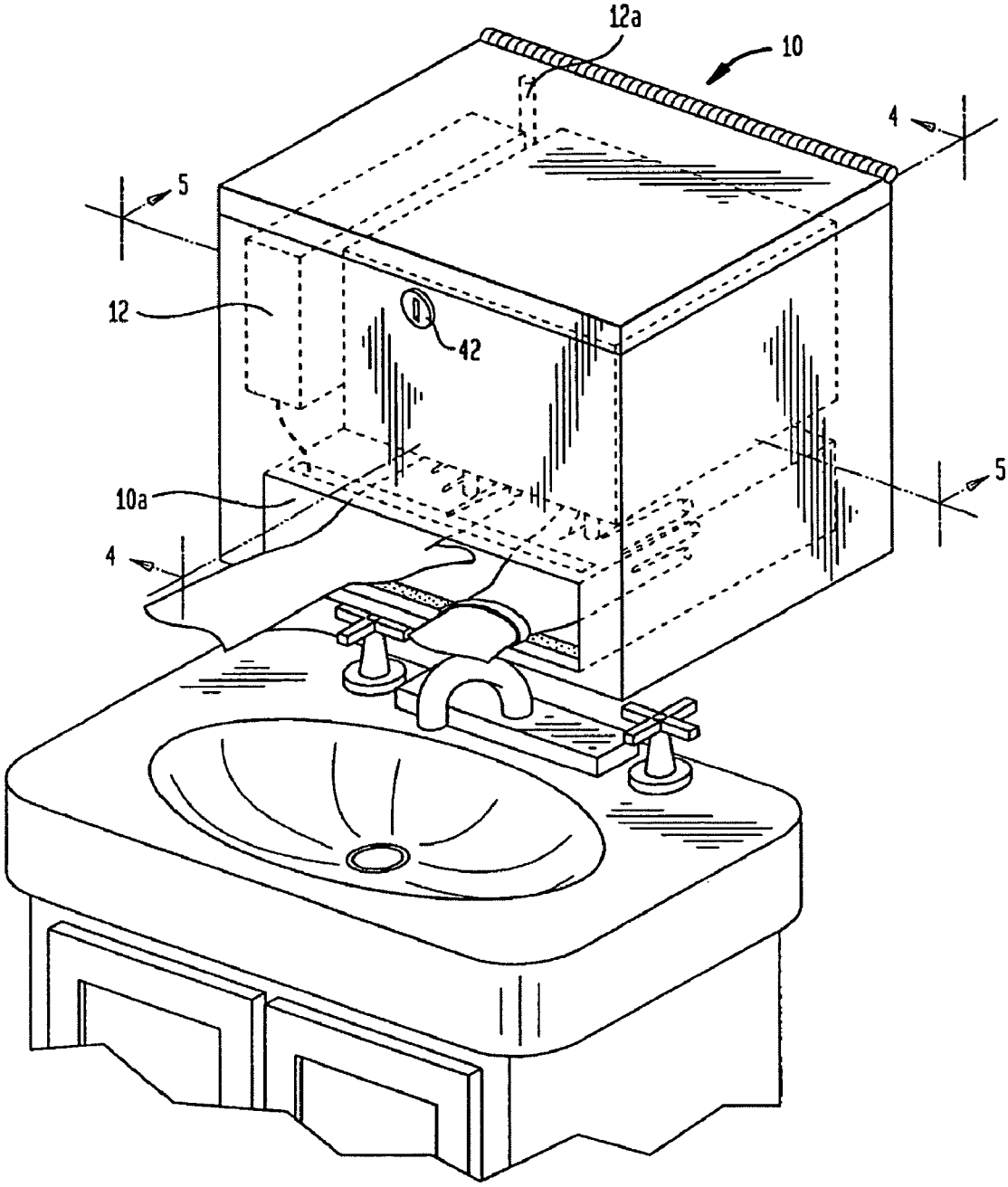
FIG. 1 is a perspective view of a hand wash monitoring system in use in conjunction with a lavatory, with an individual hands being shown inserted therein.

FIG. 1 is a perspective view illustrating a hand wash monitoring system embodying the present invention, in use by an individual. A hand cleaning station 10 is provided in the washroom in close proximity to the sink, in this case just above the sink. Station 10 is provided with a dispenser opening 10*a*, into which an individual inserts his hands prior to washing them. As will be explained below, the insertion of the hands is sensed by the station 10, which dispenses soap. The station also provides an indication to the system that the hands have been inserted.

Figure 3:
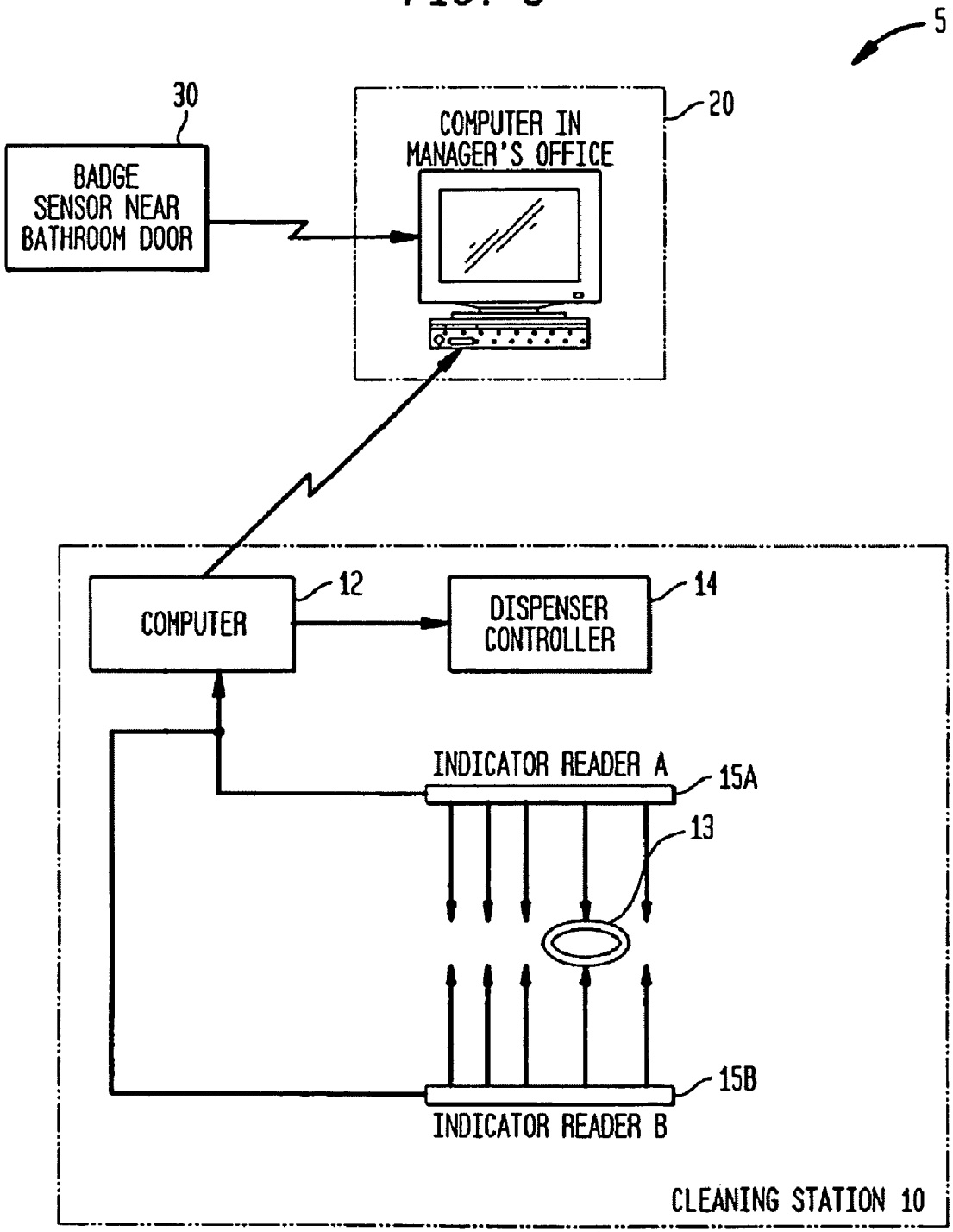
FIG. 3 is a functional block diagram illustrating the cooperation of the various components of a hand wash monitoring system.

FIG. 3 is functional block diagram illustrating the major components of the hand wash system and their cooperation. The three major components are a central computer 20 provided, for example, in a manager's office; an identity sensor 30 provided near the lavatory door, where an individual would enter and leave the lavatory; and the hand cleaning station 10 described previously. The identity sensor 30 is coupled to the central computer 20, preferably wirelessly, and senses an identification device, typically a badge, worn by an individual when he enters the lavatory.

Hand cleaning station 10 includes a system control device 12, which in the preferred embodiment is a CPU controller that provides local control and communicates, preferably wirelessly, with the central computer 20. As explained below in using the present invention, the monitored individual will wear an indicator device 13 on or about his hands. In the preferred embodiment, this is a wristband. A pair of indicator readers 15A, 15B are located inside the unit 10, and positioned so that the indicator device 13 must be located between them in order to be sensed by both. Upon sensing the indicator device 13, the indicator readers 15A, 15B transmit an indication signal to the system control device 12 indicating that the monitored individual has washed his/her hands. Upon receiving the indication signal, the system control device sends an activation signal to a dispensing controller 14, which dispensing controller 14 responds to the activation signal by activating a soap dispenser to deposit a hand wash solution 46*a* on the hands of the monitored individual.

Figure 6:
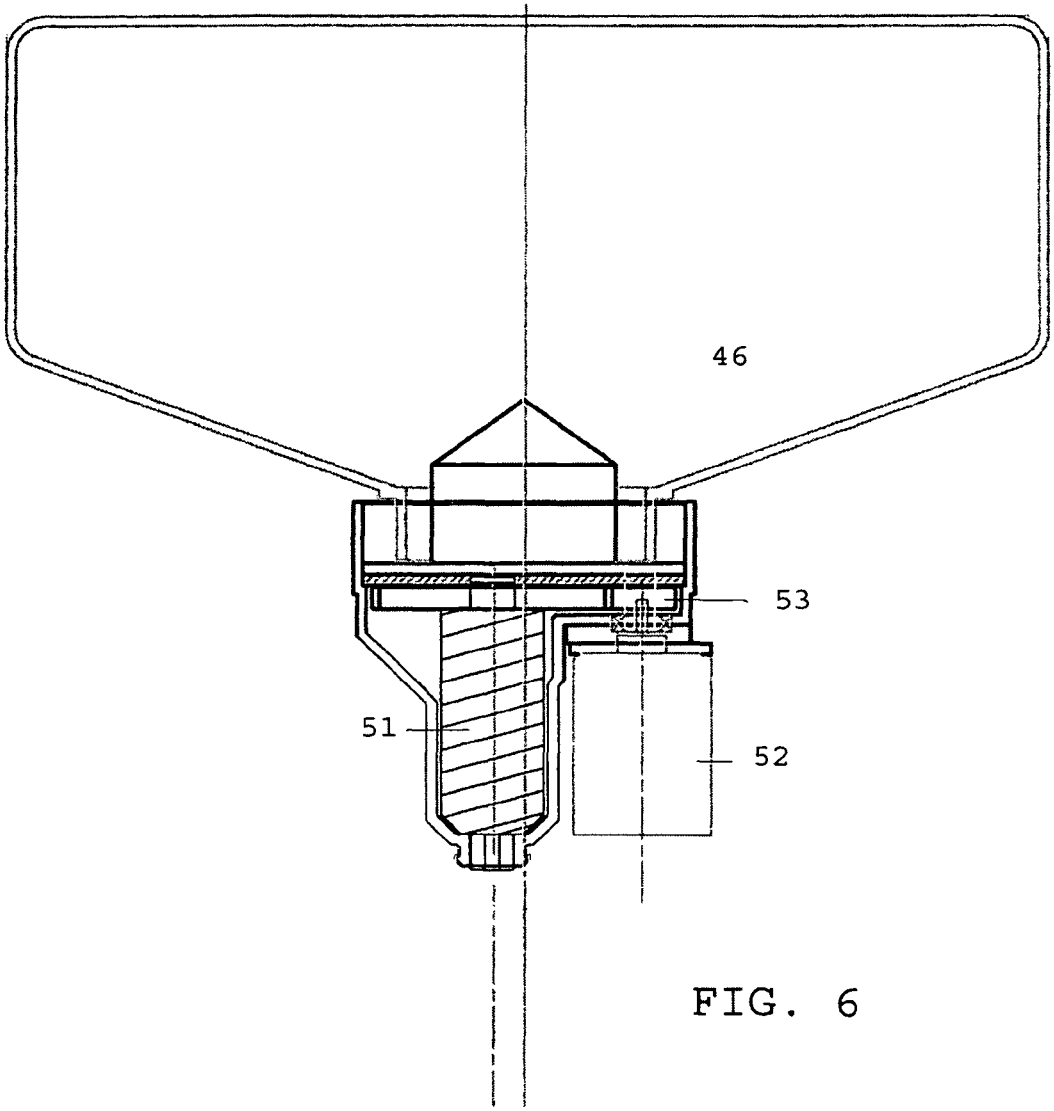
FIG. 6 is a cross-sectional detail view of one of the dispenser controllers.

As illustrated in FIG. 6, in the preferred embodiment, the dispensing controller 14 comprises a helical screw conveyor 51 and a motor 52. The activation signal causes the motor 52 to be activated for a designated time interval. The motor has a shaft which rotates when the motor 52 is activated. The shaft is coupled to the helical screw conveyor 51 by a gearing means 53, consisting to two gears, which can be spur, helical, worm, or bevel gears. Thus, when the motor 52 is activated by the activation signal, the helical screw conveyor 51 rotates for the designated time interval, thereby drawing a set quantity of hand wash solution 46*a* out of a storage tank 46 that is fluidly connected to the dispensing controller 14. The set quantity of hand wash solution 46*a* dispensed is determined by the system control device 12 based on the rotational speed of the motor, the gear ratio, the designated time interval, and the depth and pitch of the thread of the helical screw conveyor 51.

Figure 2:
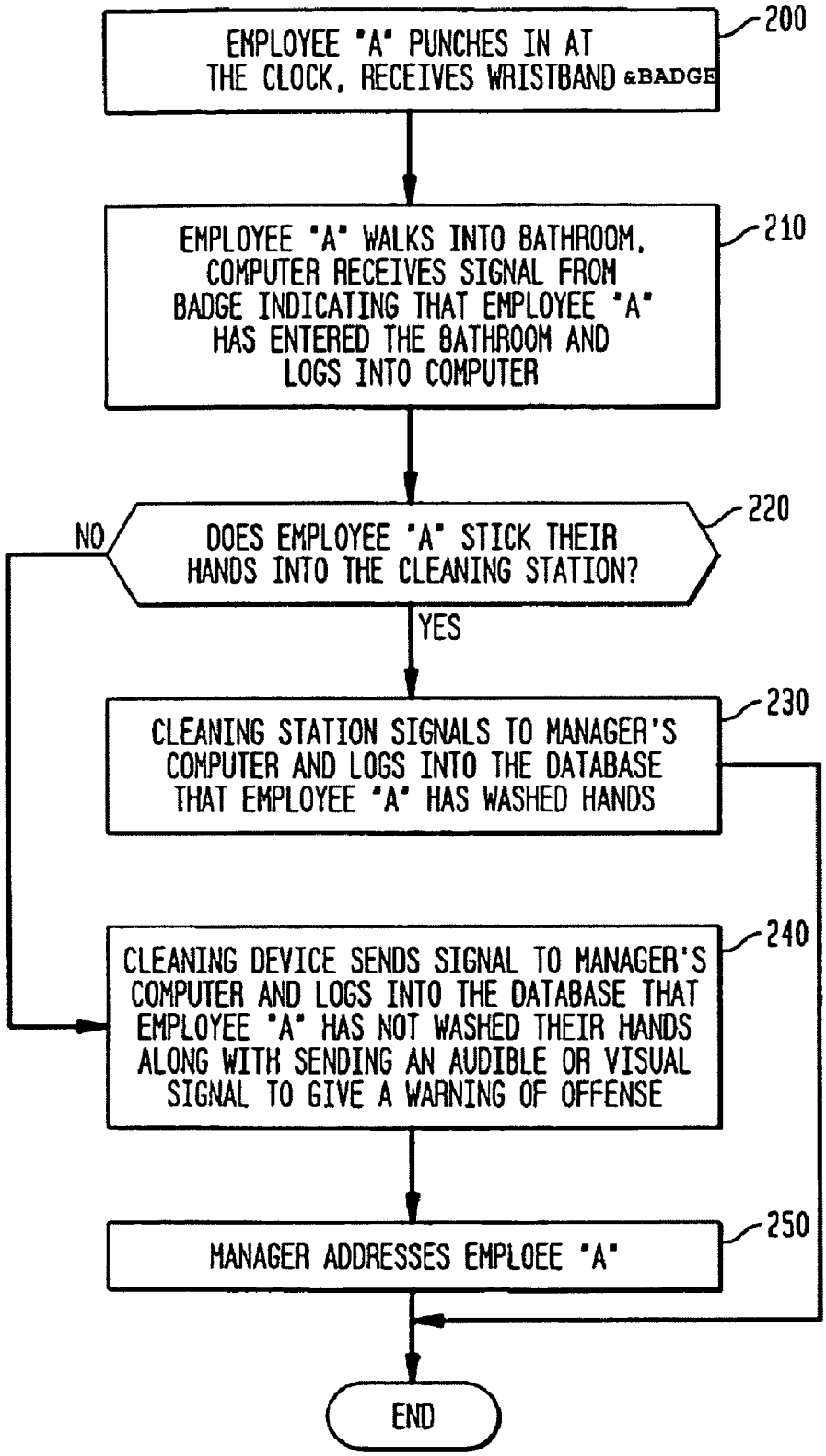
FIG. 2 is flowchart illustrating the operation of the hand wash monitoring system.

FIG. 2 is a flowchart illustrating the operation of the preferred embodiment of the present invention. In this example, it is assumed that the individual is an employee at an establishment, such as a restaurant. At step 200, the employee receives an indicator device 13 in form of a wristband when he arrives at the place of employment or punches into a clock. It will be appreciated that the indicator device could also be in the form of a ring or band worn on a finger or any other type of a device worn on or about the hands. It will also be appreciated that the indicator device could be provided to the individual at the time that he enters the bathroom. In any case, it is assumed that the establishment requires every employee to wear an identification device, typically a badge. Many such types of badges are available today, including ones that can be sensed by a remote sensor as an individual wearing the badge passes. Such an identity sensor 30 is provided in the vicinity of the bathroom door and senses the identity of an individual passing through the door. This information and the identity of the individual are transmitted to the central computer 20 (Step 210).

As explained previously, an individual would be expected to place his hands into the hand cleaning station 10 prior to departing from the bathroom. This would cause the indicator readers 15A, 15B to sense the indicator device 13 and send an appropriate message to the CPU controller 12. At the same time, soap would be deposited upon the individual's hands, and he would need to wash his hands in order to remove it.

At step 220, a test is performed to determine whether an indication signal was received from indicators 15A, 15B. This could occur when the identity sensor 30 senses that the individual has left the bathroom. If so, the CPU controller 12 signals to the central computer 20 that it has received an indication signal and an entry could be made in a database within computer 20 indicating that the individual has washed his/her hands (Step 230).

Should the CPU controller 12 not have received the indication tested for in Step 220 when the individual leaves the bathroom, the CPU controller 12 signals to the central computer 20 that the employee failed to wash his hands and an appropriate entry made in the database (Step 240). An appropriate visual or audible alarm could also be provided to draw the attention of a manager and to indicate the identity of the individual who failed to wash his hands. The manager could then have an appropriate discussion with that individual and assure that he returns to wash his hands (Step 250).

Figure 4:
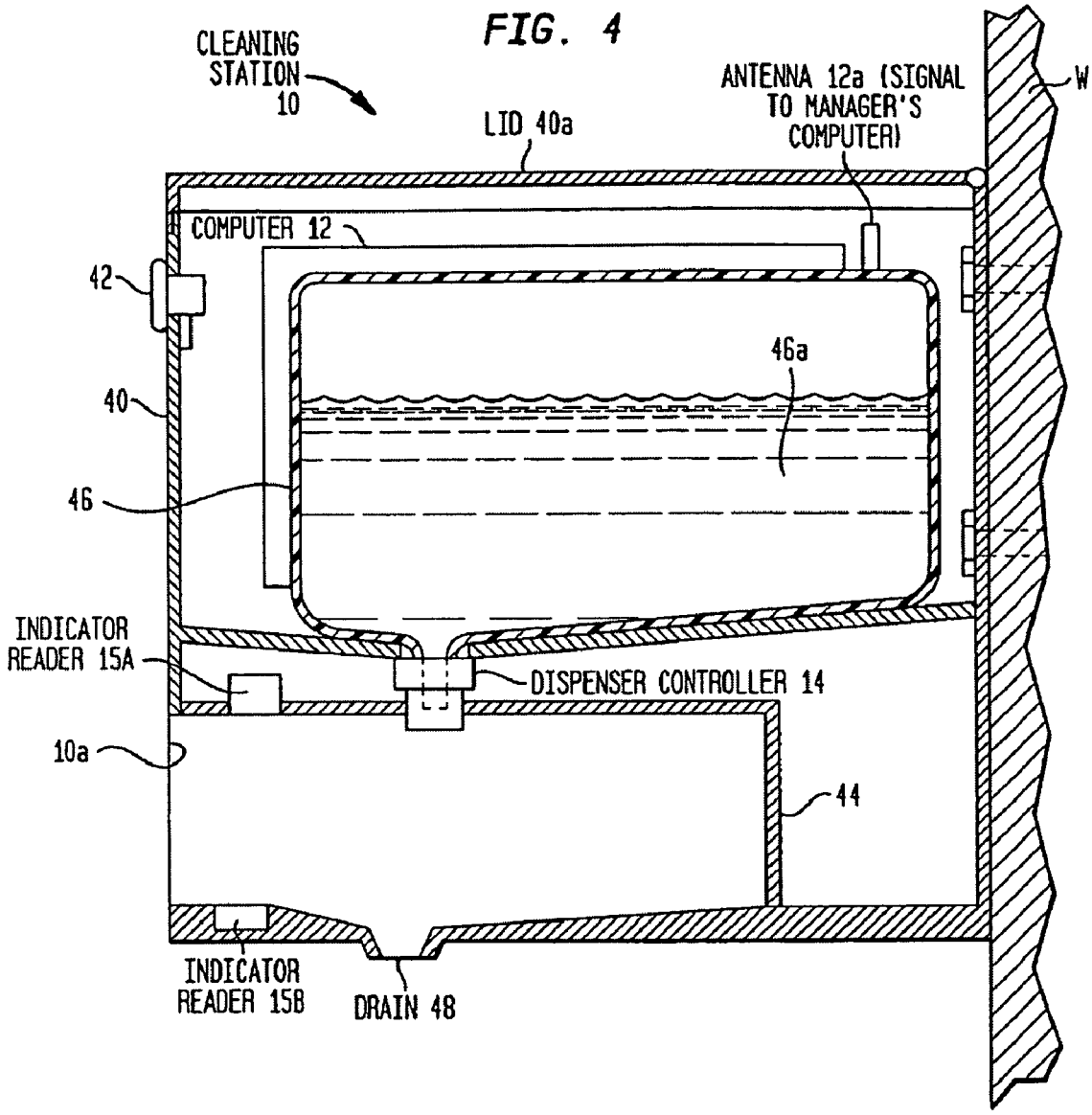
FIG. 4 is an enlarged, sectional view taken along contour 4-4 in FIG. 1 and looking in the direction of the arrows to illustrate internal details of the hand cleaning station.
Figure 5:
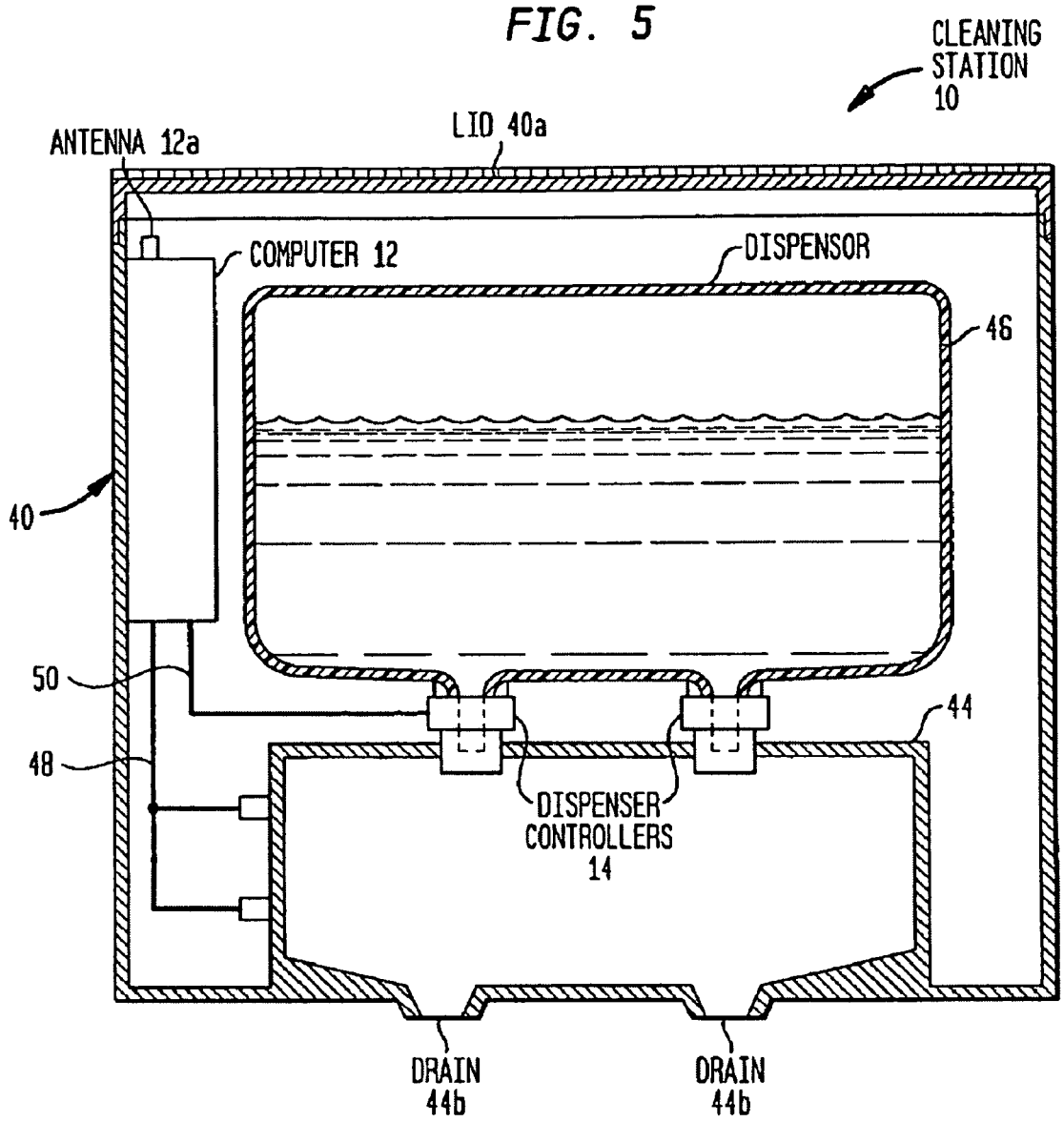
FIG. 5 is a sectional view taken along line 5-5 in FIG. 1 and looking in the direction of the arrows to illustrate further internal details of the cleaning station.

FIGS. 4 and 5 are sectional views illustrating the preferred inner construction of the cleaning station 10. As may be seen, cleaning station 10 is provided inside an enclosure 40, which includes a hinged lid 40*a*, through which the interior of the enclosure may be accessed. The lid is prevented from being opened by means of a lock 42. The CPU controller 12 is mounted on the interior of the enclosure 40 and preferably has a wireless transmitter with an antenna 12*a*. Within enclosure 40, there is provided an enclosed compartment 44 which is accessed via the dispenser opening 10*a*. Above the compartment 44, there is provided a storage tank 46 containing soap solution 46*a*. The storage tank 46 communicates with compartment 44 through the dispenser controllers 14, which enter compartment 44 from above.

Two indicator readers 15A and 15B are provided near the front of compartment 44 in upper and lower walls, respectively. In the bottom wall of compartment 44, there are provided drains 44*b*, 44*b*, which permits excess soap solution to be disposed through the sink which lies below. The CPU controller 12 is coupled to via leads 48 to the two indicator readers 15A and 15B, and it is coupled via leads 50 to the dispenser controllers 14. As may be seen in FIG. 4, the enclosure 40 is conveniently mounted, by conventional means, to a wall W within the lavatory.

Although a preferred embodiment of the invention has been disclosed for illustrative purposes, those skilled in the art will appreciate that many additions, modifications and substitutions are possible, without departing from the scope and spirit of the present invention as defined by the accompanying claims.

I claim:

1. A system for monitoring cleaning of the hands of one or more monitored individuals, comprising:

(a) an enclosed area accessed by one or more doors;

(b) one or more identity sensors located within the enclosed area, each identity sensor being proximate to one of the doors;

(c) one or more cleaning stations located within the enclosed area; each cleaning station comprising one or more sinks, each sink having one or more water faucets, one or more soap dispensers and one or more drains;

(d) one or more indicator readers located within each of the cleaning stations, each indicator reader being proximate to one of the sinks, such that each sink has proximate to it one or more indicator readers;

(e) an identification device that is worn by each monitored individual, such that when the monitored individual enters or leaves the enclosed area through one of the doors, the identity sensor that is proximate to the door senses the identification device and transmits the identity of the monitored individual who has passed through the door to a system control device;

(f) one or more indicator devices that is/are worn on or about one or both hands of each monitored individual, such that when the hands of the monitored individual are placed in the vicinity of one of the sinks, the indicator reader(s) sense(s) the presence of the indicator device(s) and transmit two signals: (i) an indication signal to the system control device indicating that the monitored individual has washed his/her hands, and (ii) an activation signal to a dispensing controller, which dispensing controller responds to the signal by activating the soap dispenser to deposit a hand wash solution on the hands of the monitored individual; and (g) an alarm that generates a warning signal whenever the system control device has received transmissions from the identity sensor(s) indicating that the monitored individual has entered and exited from the enclosed area without the system control device also having received an indication signal from the indicator reader(s) that the monitored individual has washed his/her hands.

2. The system according to claim 1, wherein the system control device is a local CPU controller.

3. The system according to claim 2, wherein the local CPU controller is located within the enclosed area.

4. The system according to claim 3, wherein the local CPU controller is located within the cleaning station.

5. The system according to any of claims 2-4, wherein the local CPU controller transmits a warning signal and/or a warning message to a remote computer whenever the local CPU controller has received transmissions from the identity sensor(s) indicating that the monitored individual has entered and exited from the enclosed area without the system control device also having received an indication signal from the indicator reader(s) that the monitored individual has washed his/her hands.

6. The system according to any of claims 1-4, wherein the dispensing controller comprises a motor and a helical screw conveyor, and wherein the activation signal causes the motor to be activated for a designated time interval, and wherein the motor has a shaft which rotates when the motor is activated, and wherein the shaft is coupled to the helical screw conveyor by a gearing means, such that when the motor is activated by the activation signal, the helical screw conveyor rotates for the designated time interval, thereby drawing a set quantity of hand wash solution out of a storage tank that is fluidly connected to the dispensing controller, and such that the set quantity of hand wash solution dispensed is determined by the system control device based on the rotational speed of the motor, the gear ratio, the designated time interval, and the depth and pitch of the thread of the helical screw conveyor.

7. The system according to claim 5, wherein the dispensing controller comprises a motor and a helical screw conveyor, and wherein the activation signal causes the motor to be activated for a designated time interval, and wherein the motor has a shaft which rotates when the motor is activated, and wherein the shaft is coupled to the helical screw conveyor by a gearing means, such that when the motor is activated by the activation signal, the helical screw conveyor rotates for the designated time interval, thereby drawing a set quantity of hand wash solution out of a storage tank that is fluidly connected to the dispensing controller, and such that the set quantity of hand wash solution dispensed is determined by the system control device based on the rotational speed of the motor, the gear ratio, the designated time interval, and the depth and pitch of the thread of the helical screw conveyor.

8. A system for monitoring cleaning of the hands of one or more monitored individuals, comprising:

(a) an enclosed area accessed by one or more doors;

(b) one or more identity sensors located within the enclosed area, each identity sensor being proximate to one of the doors;

(c) one or more cleaning stations located within the enclosed area; each cleaning station comprising one or more sinks, each sink having one or more water faucets, one or more soap dispensers and one or more drains;

(d) one or more pairs of indicator readers located within each of the cleaning stations, each pair of indicator readers comprising an indicator reader A and an indicator reader B, indicator reader A being located proximate to the soap dispenser and indicator reader B being located below indicator reader A, such that the space between indicator reader A and indicator reader B constitutes a dispenser opening through which the hands of the monitored individual are inserted in order to access the soap dispenser;

(e) an identification device that is worn by each monitored individual, such that when the monitored individual enters or leaves the enclosed area through one of the doors, the identity sensor that is proximate to the door senses the identification device and transmits identity of the monitored individual who has passed through the door to a system control device;

(f) one or more indicator devices that is/are worn on or about one or both hands of each monitored individual, such that when the hands of the monitored individual are placed beneath the soap dispenser in the dispenser opening between indicator reader A and indicator reader B, both indicator readers A and B sense the presence of the indicator device(s) and transmits two signals: (i) an indication signal to the system control device indicating that the monitored individual has washed his/her hands, and (ii) an activation signal to a dispensing controller, which dispensing controller responds to the signal by activating the soap dispenser to deposit a hand wash solution on the hands of the monitored individual; and (g) an alarm that generates a warning signal whenever the system control device has received transmissions from the identity sensor(s) indicating that the monitored individual has entered and exited from the enclosed area without the system control device also having received an indication signal from both indicator reader A and indicator reader B that the monitored individual has washed his/her hands.

9. The system according to claim 8, wherein the system control device is a local CPU controller.

10. The system according to claim 9, wherein the local CPU controller is located within the enclosed area.

11. The system according to claim 10, wherein the local CPU controller is located within the cleaning station.

12. The system according to any of claims 9-11, wherein the local CPU controller transmits a warning signal and/or warning message to a remote computer whenever the CPU controller has received transmissions from the identity sensor(s) indicating that the monitored individual has entered and exited from the enclosed area without the system control device also having received an indication signal from both indicator reader A and indicator reader B that the monitored individual has washed his/her hands.

13. The system according to any of claims 8-11, wherein the dispensing controller comprises a motor and a helical screw conveyor, and wherein the activation signal causes the motor to be activated for a designated time interval, and wherein the motor has a shaft which rotates when the motor is activated, and wherein the shaft is coupled to the helical screw conveyor by a gearing means, such that when the motor is activated by the activation signal, the helical screw conveyor rotates for the designated time interval, thereby drawing a set quantity of hand wash solution out of a storage tank that is fluidly connected to the dispensing controller, and such that the set quantity of hand wash solution dispensed is determined by the system control device based on the rotational speed of the motor, the gear ratio, the designated time interval, and the depth and pitch of the thread of the helical screw conveyor.

14. The system according to claim 12, wherein the dispensing controller comprises a motor and a helical screw conveyor, and wherein the activation signal causes the motor to be activated for a designated time interval, and wherein the motor has a shaft which rotates when the motor is activated, and wherein the shaft is coupled to the helical screw conveyor by a gearing means, such that when the motor is activated by the activation signal, the helical screw conveyor rotates for the designated time interval, thereby drawing a set quantity of hand wash solution out of a storage tank that is fluidly connected to the dispensing controller, and such that the set quantity of hand wash solution dispensed is determined by the system control device based on the rotational speed of the motor, the gear ratio, the designated time interval, and the depth and pitch of the thread of the helical screw conveyor.

15. A method for monitoring cleaning of the hands of one or more monitored individuals, comprising:

(a) sensing the identity of the monitored individual as he/she enters and exits an enclosed area;

(b) transmitting to a system control device an identification signal identifying the monitored individual who has entered and exited the enclosed area;

(c) detecting the presence of an indicator device worn on or about the hands of the monitored individual when his/her hands are positioned in a cleaning station between two paired indicator readers, which indicator readers are positioned one below the other, such that the space between the indicator readers constitutes a dispenser opening through which the hands of the monitored individual are inserted in order to access a soap dispenser in the cleaning station;

(d) transmitting an indicator signal to a system control device when the indicator device is detected within the dispenser opening by the two paired indicator readers;

(e) transmitting an activation signal to a dispensing controller when the indicator device is detected within the dispenser opening by the two paired indicator readers, which dispensing controller responds to the signal by activating the soap dispenser to deposit a hand wash solution on the hands of the monitored individual; and (f) generating a warning whenever the system control device has received an identification signal without having received a hand washing signal.

16. The method according to claim 15, wherein the system control device is a local CPU controller.

17. The method according to claim 16, wherein the local CPU controller is located within the enclosed area.

18. The method according to claim 17, wherein the local CPU controller is located within the cleaning station.

19. The method according to any of claims 16-18, further comprising a step whereby the local CPU controller transmits a warning signal and/or warning message to a remote computer whenever the system control device has received an identification signal without having received an indicator signal.

20. The method according to any of claims 15-18, wherein the dispensing controller comprises a motor and a helical screw conveyor, and wherein the activation signal causes the motor to be activated for a designated time interval, and wherein the motor has a shaft which rotates when the motor is activated, and wherein the shaft is coupled to the helical screw conveyor by a gearing means, such that when the motor is activated by the activation signal, the helical screw conveyor rotates for the designated time interval, thereby drawing a set quantity of hand wash solution out of a storage tank that is fluidly connected to the dispensing controller, and such that the set quantity of hand wash solution dispensed is determined by the system control device based on the rotational speed of the motor, the gear ratio, the designated time interval, and the depth and pitch of the thread of the helical screw conveyor.

21. The method according to claim 19, wherein the dispensing controller comprises a motor and a helical screw conveyor, and wherein the activation signal causes the motor to be activated for a designated time interval, and wherein the motor has a shaft which rotates when the motor is activated, and wherein the shaft is coupled to the helical screw conveyor by a gearing means, such that when the motor is activated by the activation signal, the helical screw conveyor rotates for the designated time interval, thereby drawing a set quantity of hand wash solution out of a storage tank that is fluidly connected to the dispensing controller, and such that the set quantity of hand wash solution dispensed is determined by the system control device based on the rotational speed of the motor, the gear ratio, the designated time interval, and the depth and pitch of the thread of the helical screw conveyor.

* * * * *